US009695610B2

(12) United States Patent
Sonoda et al.

(10) Patent No.: US 9,695,610 B2
(45) Date of Patent: Jul. 4, 2017

(54) SPEAKER COVER

(71) Applicant: YAMAHA CORPORATION, Hamamatsu-shi (JP)

(72) Inventors: Shinya Sonoda, Hamamatsu (JP); Kenji Ishibashi, Sumida-ku (JP); Akihiro Sonogi, Hamamatsu (JP); Tsutomu Watanabe, Hamamatsu (JP); Yuji Sakurai, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/804,611

(22) Filed: Jul. 21, 2015

(65) Prior Publication Data

US 2016/0069100 A1 Mar. 10, 2016

(30) Foreign Application Priority Data

Sep. 5, 2014 (JP) ..... 2014-181184

(51) Int. Cl.

| | |
|---|---|
| ***E04H 15/02*** | (2006.01) |
| ***A47C 7/66*** | (2006.01) |
| ***E04H 15/54*** | (2006.01) |
| ***H04R 1/02*** | (2006.01) |

(52) U.S. Cl.

CPC ..... *E04H 15/02* (2013.01); *A47C 7/66* (2013.01); *E04H 15/54* (2013.01); *H04R 1/023* (2013.01)

(58) Field of Classification Search

CPC ..... E04H 15/48; E04H 15/02; E04H 15/58; E04H 15/10; H04R 1/02; H04R 1/086; H04R 1/023

USPC .... 135/91, 96, 117, 143, 909; 181/198–199, 181/143; 381/333, 336, 388, 189; 312/7.2; 150/154, 158, 162

See application file for complete search history.

(56) References Cited

U.S. PATENT DOCUMENTS

| | | | | | |
|---|---|---|---|---|---|
| 1,509,009 | A | * | 9/1924 | Weinberg | B65D 65/08 150/162 |
| 1,533,820 | A | * | 4/1925 | Whitehead | E04H 15/26 135/117 |
| 3,062,917 | A | * | 11/1962 | Rose | H04N 5/65 312/7.2 |
| 3,865,429 | A | * | 2/1975 | Barker | E04H 1/1205 135/117 |
| 5,218,474 | A | * | 6/1993 | Kirschner | H04N 5/65 348/842 |
| 5,474,185 | A | * | 12/1995 | Franke | B65D 65/02 150/158 |
| 5,782,360 | A | * | 7/1998 | Markson | B65D 19/385 150/154 |

(Continued)

FOREIGN PATENT DOCUMENTS

| | | | |
|---|---|---|---|
| JP | 09205694 | A | 8/1997 |
| JP | 2012109715 | A | 6/2012 |

*Primary Examiner* — Winnie Yip

(74) *Attorney, Agent, or Firm* — Rossi, Kimms & McDowell LLP

(57) ABSTRACT

A cover body (22) includes side surface portions (22*a*, 22*b*) that surround a housing (2) of a speaker (1) in an installed state, and a ceiling surface portion (22*c*) that covers the side surface portions (22*a*, 22*b*). An open portion (23) that can expose an operation portion (9) of the speaker (1) is formed in one of the side surface portions (22*b*), and an overhang portion (24) that protrudes from the surface of the side surface portion (22*b*) is provided above the open portion (23).

8 Claims, 10 Drawing Sheets

(56) References Cited

U.S. PATENT DOCUMENTS

| | | | | |
|---|---|---|---|---|
| 6,209,973 | B1 * | 4/2001 | Steinberg | G06F 1/1601 312/204 |
| 6,402,269 | B1 * | 6/2002 | Roth | G06F 1/1601 312/208.3 |
| 6,430,954 | B1 * | 8/2002 | Smith | F24F 1/58 135/913 |
| D620,703 | S * | 8/2010 | Jacobs | D3/218 |
| 2011/0174570 | A1 * | 7/2011 | Freed | H04R 1/023 181/199 |
| 2015/0296282 | A1 * | 10/2015 | Fujioka | H04R 1/02 381/79 |

* cited by examiner

SPEAKER COVER

TECHNICAL FIELD

The present invention relates to a speaker cover used to cover a speaker in order to prevent rain and the like from falling on an operation portion including operation nobs, connectors, and the like when the speaker is used outdoors.

BACKGROUND ART

A speaker includes a diaphragm that is cone-shaped, for example, an actuator made up of a magnet and a coil for causing the diaphragm to vibrate, a housing for containing sound emitted from the rear of the diaphragm, and the like. When this speaker is used outdoors, it is necessary to prevent it from become wet with rain.

JP H9-205694A discloses a drip-proof speaker box. This patent document discloses that in this drip-proof speaker box, cable terminals for the connection of speaker cables are arranged in a recessed portion of the speaker box, and a cover for covering the speaker box is attached thereto via an elastic member made of rubber, sponge, flexible plastic, or the like, thus preventing the cable terminal portions of the speaker box from becoming wet with rainwater or the like, and making it possible to reliably prevent rust and connection failures.

JP 2012-109715A discloses a speaker in an electronic terminal device, in which the speaker unit is built into a water resistant protective case made of a synthetic resin molding.

SUMMARY OF INVENTION

The speaker box and protective case disclosed in these patent documents are capable of protecting a speaker from rainwater according to their drip-proof or waterproof specifications, but also have complex structures and tend to become heavy when the size of the speaker increases. Also, since the box or case itself is given a drip-proof or waterproof structure, consideration is not given to removing the box or case during use when the weather is clear or in an environment in which waterproofing is not required.

The present invention has been achieved in light of the above circumstances, and an object thereof is to provide a speaker cover having a simple structure that can be attached to a speaker as necessary and prevent rain and the like from falling on an operation portion.

A speaker cover according to the present invention is a speaker cover for attachment to a speaker that includes a housing having a plurality of side surfaces and a ceiling surface, and an operation portion provided on one of the side surfaces, the speaker cover including: a cover body having a plurality of side surface portions covering the side surfaces of the speaker, and a ceiling surface portion connected to the side surface portions and covering the ceiling surface of the speaker; an open portion provided in the cover body and configured to expose the operation portion of the speaker; and an overhang portion provided above the open portion and protruding from the cover body.

The cover body has a structure including the side surface portions and the ceiling surface portion, and does not have a bottom surface portion, and thus can be placed over the speaker. In this case, even if cables are connected to the speaker, the cover body can be removably attached to the speaker without being hindered by the cables. By exposing the operation portion of the speaker through the open portion of the cover body placed over the speaker, operations can be performed on the operation portion from outside the cover body. Since the overhang portion is provided above the open portion, it is possible to prevent the operation portion from becoming wet with rain or the like. Also, if the speaker includes an electrical circuit such as an amplifier, heat generated by the electrical circuit needs to be released to the outside, and since the space inside the cover body is open to the outside through the open portion, heat emitted from the speaker can be released to the outside through the open portion.

Note that the overhang portion may be provided so as to protrude from the upper edge of the open portion, or it may be provided so as to extend the ceiling surface portion of the cover body.

In the speaker cover according to the present invention, a side wall portion that protrudes from a surface of the cover body may be provided on each of two side portions of the overhang portion so as to extend downward from a lower surface of the overhang portion.

The two side portions of the overhang portion are supported from below by the side wall portions, and even if the overhang portion is formed using a relatively flexible material such as fabric, the protruding position of the overhang portion can be stably maintained. Also, since the side wall portions also protrude from the cover body likewise to the overhang portion, three sides of the open portion are surrounded by the overhang portion and the side wall portions, and it is possible to prevent the intrusion of rain and the like on these three sides of the open portion.

In the case of these side wall portions as well, the side wall portions may be provided so as to protrude from side edges of the open portion, or may be provided so as to extend the side surface portions of the cover body arranged on the two lateral sides of the open portion.

Note that the overhang portion may have a hanging portion that hangs down from the protruding end portion of the overhang portion. The provision of the hanging portion makes it possible to reliably prevent the intrusion of rain and the like into the open portion.

Also, instead of providing the hanging portion, an obstructing portion that obstructs a portion of the open portion below the overhang portion may be provided between the two side wall portions, with a gap between it and the overhang portion.

In the speaker cover of the present invention, it is preferable that the overhang portion is displaceable between a protruding position of protruding from the cover body and an obstructing position of being arranged along the cover body, and is provided with a size large enough to be able to obstruct the open portion when in the obstructing position.

When the speaker is not in use, for example, the overhang portion can be caused to hang down in the obstructing position so as to obstruct the open portion, thus making it possible to prevent dust and the like from attaching to the speaker, and protect the speaker during transport and the like.

In the speaker cover in which the cover body has side wall portions, it is preferable that the overhang portion and the side wall portions are displaceable between a protruding position of protruding from the cover body and an obstructing position of being arranged along the cover body, and in the obstructing position, at least one of the overhang portion and the side wall portions, or a combination of at least two out of the overhang portion and the side wall portions is provided with a size large enough to obstruct the open portion.

Putting the overhang portion and the side wall portions in the obstructing position when the speaker is not in use, for example, makes it possible to cover the open portion.

Also, if the side wall portions protrude outward when the overhang portion protrudes from the surface of the cover body, the overhang portion can be supported from below by the side wall portions, and the protruding position of the overhang portion can be stably maintained.

In the speaker cover of the present invention, it is preferable that the side wall portions each have a protruding length greater than or equal to half the width of the open portion, an opening portion in communication with the upper portion of the open portion is configured to be formed between the overhang portion and the upper portions of the side wall portion by pointing the lower portions of the protruding ends of the side wall portions toward each other, and the overhang portion and the side wall portions forming the opening portion are configured to be latched to the upper end portions of the side wall portions and the two side portions of the overhang portion.

If the two side wall portions are opened halfway, the lower portions of the protruding ends thereof are pointed toward each other, and the upper end portions thereof are latched to the two side portions of the overhang portion, a chimney-shaped space having a triangular horizontal cross-section can be formed by the two side wall portions in front of the open portion, and since an opening portion is formed at the upper end portion of the space, heat can be effectively released from the speaker to the outside through the opening portion.

Note that in the case where the speaker cover of the present invention is formed from fabric or the like, the fabric may have a mesh structure or be formed using a waterproof material or a water repelling material that repels water drops, or be coated with a water repelling resin.

A speaker cover of the present invention can cover a speaker with the simple operation of being placed over the speaker, can be attached to a speaker as necessary and prevent rain or the like from falling on an operation portion, and has a simple structure.

DESCRIPTION OF EMBODIMENTS

Hereinafter, embodiments of the present invention will be described with reference to the drawings.

Example of Speaker

Figure 1:
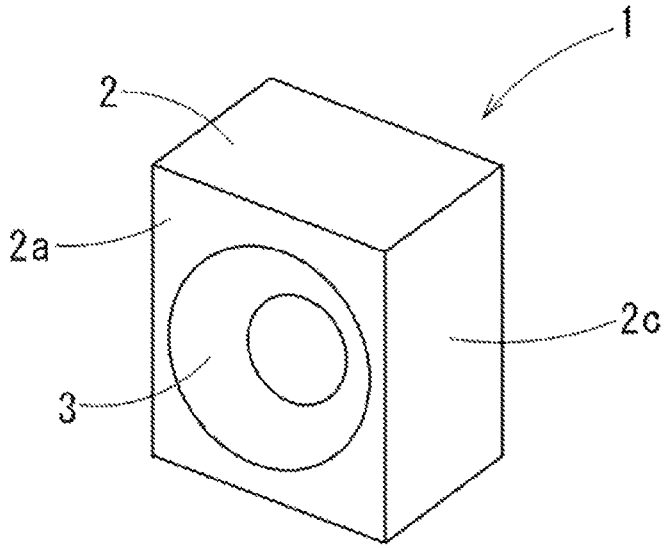
FIG. 1 is a front perspective view of an example of a speaker to which a speaker cover according to the present invention is applied.
Figure 2:
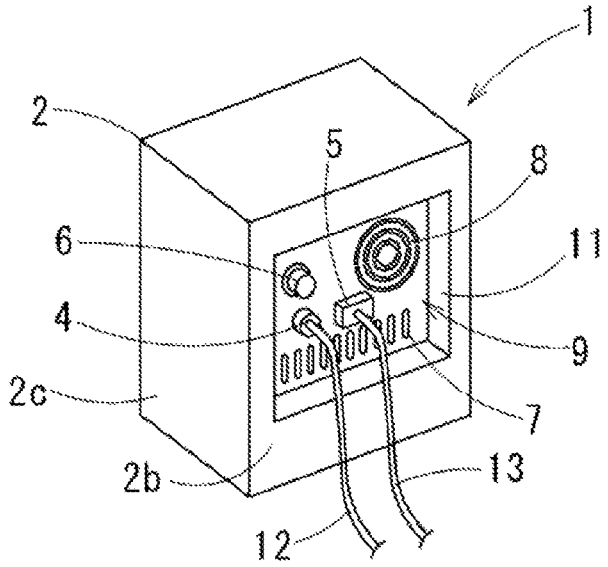
FIG. 2 is a rear perspective view of the speaker in FIG. 1.

First, the following describes a speaker on which a speaker cover of the present invention is used. As shown in FIGS. 1 and 2, a speaker 1 includes a housing 2 that is overall cuboid in shape. The housing 2 has a front surface 2*a*, a rear surface 2*b*, two side surfaces 2*c* and 2*d*, a ceiling surface 2*e*, and a bottom surface. A cone-shaped diaphragm 3 is provided on the front surface 2*a* of the housing 2, and various types of connector jacks 4 and 5, an operation nob 6 for volume adjustment or the like, intake holes 7, and exhaust holes 8 are arranged on the rear surface 2*b* of the housing 2. Note that state shown in FIGS. 1 and 2 is the installed state of the speaker 1, and the up-down direction, left-right direction, and front-rear direction are directions with respect to this installed state.

The portion of the rear surface 2*b* of the housing 2 that is provided with the jacks and the like is called an operation portion 9, and the intake holes 7 and the exhaust holes 8 are also provided in the operation portion 9. Normally, the operation portion 9 is provided on the rear surface 2*b* of the housing 2, but there are cases where it is provided on a surface other than the rear surface 2*b*, such as the side surface 2*c* or 2*d*, and also cases where the operation portion is provided at position below the diaphragm 3 on the front surface 2*a* where the diaphragm 3 is exposed. In the present invention, the front surface 2*a*, the rear surface 2*b*, and the side surfaces 2*c* and 2*d* are all called side surfaces. Note that the installed state can be changed. For example, in the case where the side surface 2*c* is placed on the installation surface, the side surface 2*d* becomes the ceiling surface of the present invention, and the front surface 2*a*, the rear surface 2*b*, the ceiling surface 2*e*, and the bottom surface become the side surfaces of the present invention.

In the examples shown in the figures, a rectangular recessed portion 11 is formed in the rear surface 2*b* of the housing 2. The audio cable jack 4, the power cable jack 5, the operation nob 6, the intake holes 7, and the exhaust holes 8, which are representative examples of members provided in the operation portion 9, are provided in the recessed portion 11. Although not shown in the figures, an amplifier and the like are arranged inside the housing 2, and an exhaust fan is provided on the inward side of the exhaust holes 8. As shown in FIG. 2, an audio cable 12 and a power cable 13 are connected to the audio cable jack 4 and the power cable jack 5.

The following describes various embodiments that can be applied as a speaker cover used on the speaker 1.

First Embodiment

A speaker cover of a first embodiment includes a cover body that has a cuboid external shape and surrounds the housing 2 of the speaker 1. An open portion that exposes the operation portion 9 is formed in one of the side surface portions of the cover body, and an overhang portion and side wall portions are formed so as to protrude from the upper edge and side edges of the open portion. These portions will be described in detail below.

Figure 3:
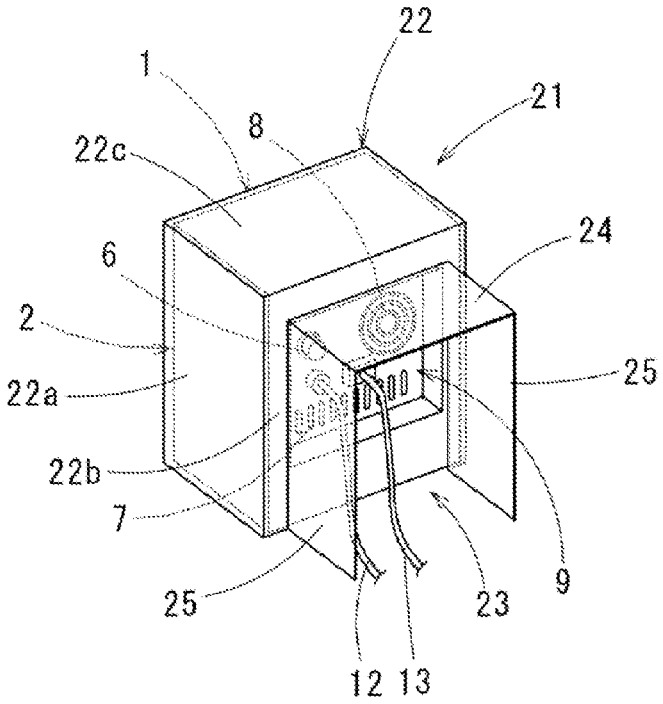
FIG. 3 is a rear perspective view of a speaker cover according to a first embodiment of the present invention, in a state of covering a speaker.
Figure 4:
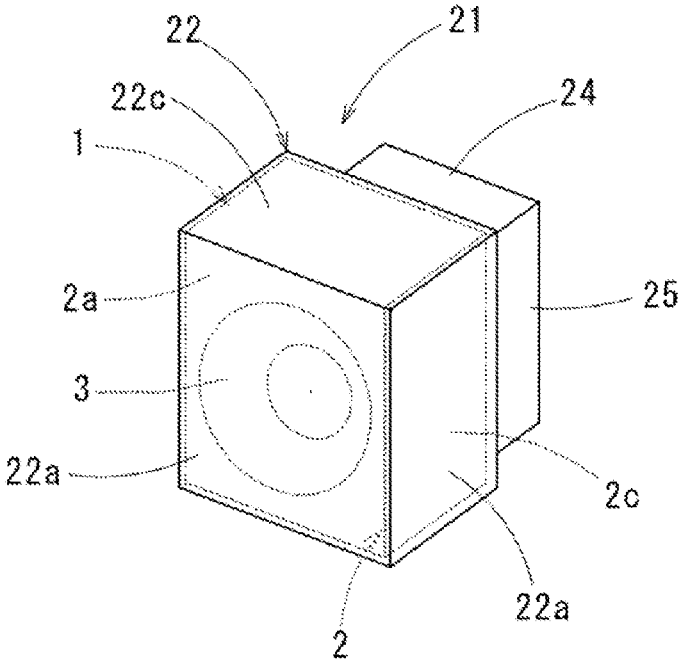
FIG. 4 is a front perspective view of the speaker box and the speaker in FIG. 3.

FIGS. 3 and 4 show a representative example of a speaker cover 21 of the first embodiment that includes a cover body 22 that has a cuboid external shape and surrounds the housing 2 of the speaker 1. An open portion 23 that exposes the operation portion 9 of the speaker 1 is formed in the cover body 22, an overhang portion 24 is formed so as to protrude from the upper edge of the open portion, and side wall portions 25 are formed so as to protrude from the two side edges of the open portion 23. In this case, the overhang portion 24 and the side wall portions 25 are formed so as to protrude the same length, but they may have different lengths.

The cover body 22, the overhang portion 24, and the side wall portions 25 are formed from a fabric or board material. Although there are no particular limitations on the fabric or board material, one example is a fabric material that is made by weaving fibers made of a synthetic resin such as polyester, and is then given a waterproof coating using polyvinyl chloride or the like.

The cover body 22 has side surface portions 22*a* and 22*b* that surround the four sides of the housing 2 of the speaker 1, and a ceiling surface portion 22*c* that covers the top (i.e., the ceiling surface 2*e*) of the housing 2. The cover body 22 does not have a bottom surface, and therefore can be placed over the speaker 1.

The open portion 23 provided in the cover body 22 is formed by removing a major portion extending from the bottom of one of the side surface portions (the rear surface portion) 22*b*, while leaving the upper end portion and the two side portions remaining. Also, the overhang portion 24 and the two side wall portions 25 protrude outward from this side surface portion 22*b*, and the upper ends of the side wall portions 25 are connected to respective side ends of the overhang portion 24. Accordingly, the overhang portion 24 and the two side wall portions 25 function as a hood that surrounds the open portion 23 on three sides not including the lower side.

Although FIGS. 3 and 4 show an example in which the overhang portion 24 and the two side wall portions 25 protrude from the side surface portion 22*b* at right angles, it is not necessarily required for the angle to be a right angle, and they need only protrude outward. Also, although the open portion 23 is shown having a rectangular shape, there is no need for the shape to be a rectangular shape, as long as the operation portion 9 can be exposed. The overhang portion 24 does not need to be shaped as a flat plate as shown in the figures, and may be mountain-shaped like a gable. Also, a configuration is possible in which the overhang portion 24 is curved so as to be shaped as an arc-shaped plate, and the overhang portion and the two side wall portions form a continuous arc shape.

Note that it is preferable that the material constituting the speaker cover 21 is thick in order to protect the speaker 1 from impacts and the like. Also, since the side surface portion 22*a* on the side opposite to the open portion 23 (i.e., the front surface portion) is the surface where the diaphragm 3 is arranged when the cover body 22 is placed over the speaker 1, it is preferable that the material constituting the front surface portion has a reduced thickness or is a mesh material or the like in order to not hinder the emission of sound from the diaphragm 3.

When the speaker cover 21 is placed over the speaker 1, the open portion 23 is aligned with the operation portion 9 of the speaker 1 such that the operation portion 9 of the speaker 1 is exposed through the open portion 23, and three sides of the operation portion 9 are surrounded by the overhang portion 24 and the two side wall portions 25. Although the audio cable 12 and the power cable 13 are connected to the speaker 1 as previously described, the cables 12 and 13 do not interfere with the cover body 22 when the speaker cover 21 is placed over the speaker 1 since the open portion 23 reaches the lower end of the cover body 22.

Due to covering the speaker 1 with the speaker cover 21, the operation portion 9 of the speaker 1 is surrounded on three sides by the overhang portion 24 and the side wall portions 25. This enables preventing rain and the like from falling on the operation portion 9 even if the speaker 1 is used outdoors or the like. Of course, since the operation portion 9 is exposed through the open portion 23, there is no impairment to performing various operations. Also, since the intake holes 7 and the exhaust holes 8 are also exposed, the release of heat from the housing 2 of the speaker 1 is not hindered. Accordingly, the speaker cover 21 can be removably placed over the speaker 1 even while the cables 12 and 13 are connected.

Variation of First Embodiment

Figure 5:
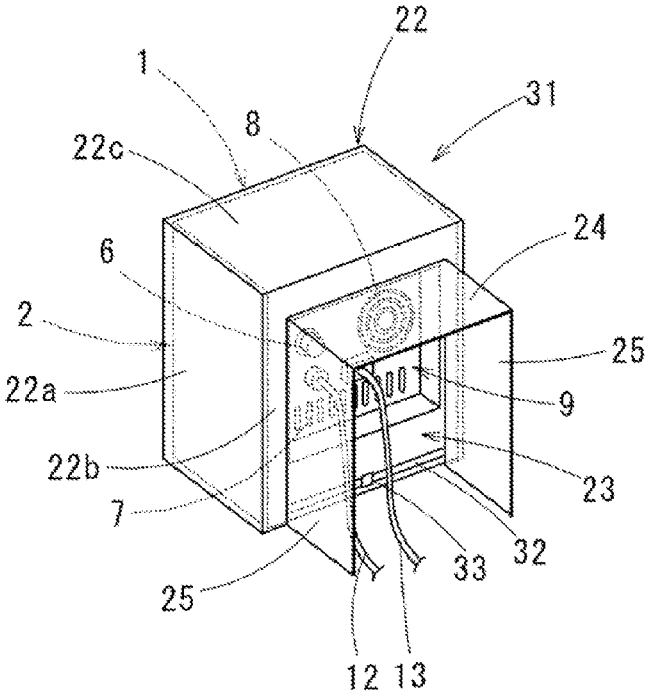
FIG. 5 is a rear perspective view of a variation of the first embodiment.
Figure 6:
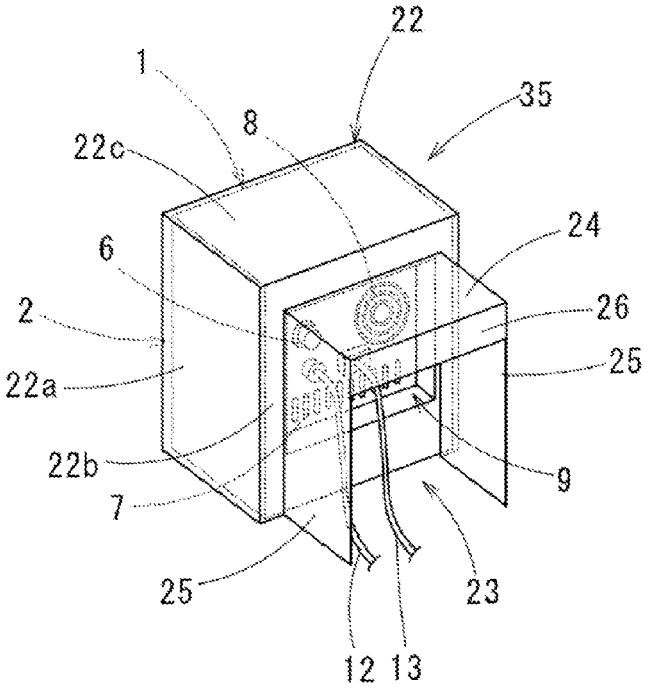
FIG. 6 is a rear perspective view of another variation.

The speaker cover 21 of the first embodiment, in which the overhang portion 24 and the side wall portions 25 protrude from the open portion 23 of the cover body 22, can have the structures shown in FIGS. 5 and 6. Note that only portions different from the speaker cover shown in FIGS. 3 and 4 are denoted by new reference signs in FIGS. 5 and 6.

With a speaker cover 31 according to a variation shown in FIG. 5, a band 32 that connects the two side edges of the open portion 23 is provided in the lower end portion of the open portion 23 so as to prevent spreading of the cover body 22. The band 32 may maintain the state of connecting the two side edges of the open portion 23 as long as it is provided with a narrow width in the lower end portion of the open portion 23. Note that a length adjustment portion 33 such as a buckle can be provided at a midpoint in the length direction so as to enable adjustment of the length of the band 32 as shown in FIG. 5. Also, a configuration is possible in which the band 32 is bisected into left and right portions, and a faster or the like that can connect the two tip portions is provided.

With a speaker cover 35 according to another variation shown in FIG. 6, a hanging portion 26 that extends vertically downward may be integrally provided on the protruding end of the overhang portion 24. Also, the hanging portion 26 is provided so as to connect the upper end portions of the two side wall portions 25, thus preventing unintentional spreading of the overhang portion 24 and the two side wall portions 25. Moreover, the provision of the hanging portion 26 makes it possible to improve the effect of preventing rain and the like from falling on the operation portion 9 without increasing the protruding length.

Figure 7:
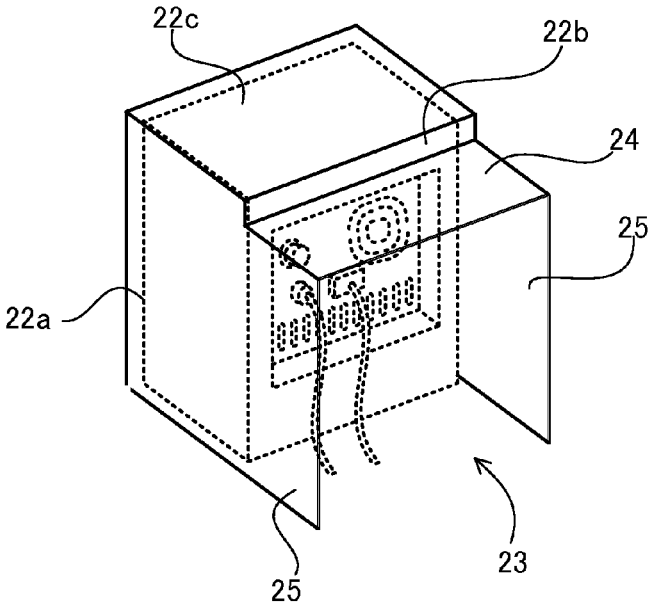
FIG. 7 is a rear perspective view of yet another variation.
Figure 8:
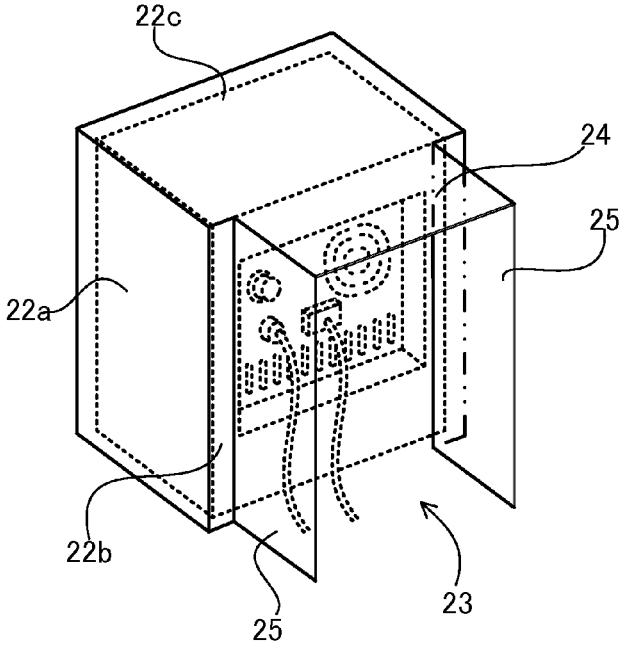
FIG. 8 is a rear perspective view of still another variation.
Figure 9:
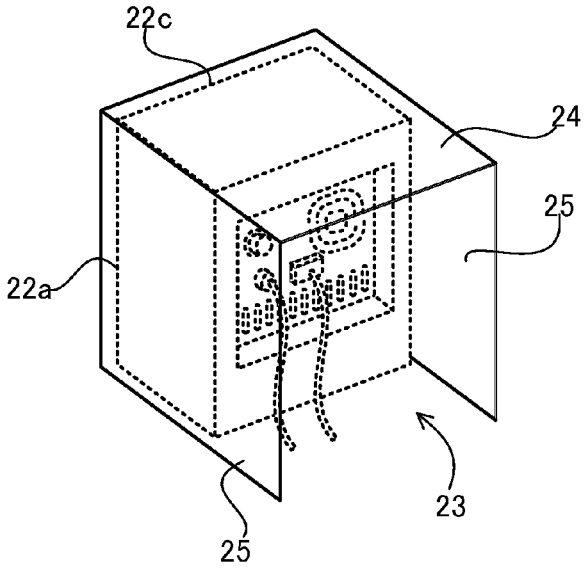
FIG. 9 is a rear perspective view of still another variation.

With each of the speaker covers 21, 31, and 35 shown in FIGS. 3 to 6, the cover body 22 includes the side surface portions 22*a* and 22*b* on four sides, and the open portion 23 is formed in the central portion, excluding the upper end portion and the two side portions, of one of the side surface portions (the rear surface portion) 22*b*. However, variations such as the following are possible. For example, as shown in FIG. 7, a configuration is possible in which the open portion 23 is formed in the portion of one side surface portion (the rear surface portion) 22*b* excluding only the upper end portion thereof, and the side wall portions 25 below the overhang portion 24 are formed so as to be flush and continuous with the side surface portions 22*a* on the two sides of the cover body 22 so as to extend the two side surface portions 22*a* rearward. Alternatively, as shown in FIG. 8, a configuration is possible in which the open portion 23 is formed in the portion of one side surface portion (the rear surface portion) 22*b* excluding only the two side portions, and the overhang portion 24 is formed so as to be flush and continuous with the ceiling surface portion 22*c* of the cover body 22 so as to extend the ceiling surface portion 22*c*. As shown in FIG. 9, a configuration is possible in which the one side surface portion (the rear surface portion) is omitted so as to entirely serve as the open portion 23, the ceiling surface portion 22*c* of the cover body 22 and the overhang portion 24 are formed as flush and continuous surfaces, and the side surface portions 22*a* on the two sides of the cover body 22 and the side wall portions 25 below the overhang portion 24 are formed as flush and continuous surfaces.

Among these variations, in the case where the side surface portions 22*a* on the two sides of the cover body 22 and the side wall portions 25 below the overhang portion 24 are formed as flush and continuous surfaces, one of the four sides of the cover body 22 is open over the entire width, thus making it easy to place the speaker cover 21 over the speaker 1.

Second Embodiment and Variations

Although the side wall portions 25 are provided so as to be continuous with the overhang portion 24 in the first embodiment, only the overhang portion is provided in a speaker cover of a second embodiment. The following describes the second embodiment and variations thereof in detail.

Figure 10:
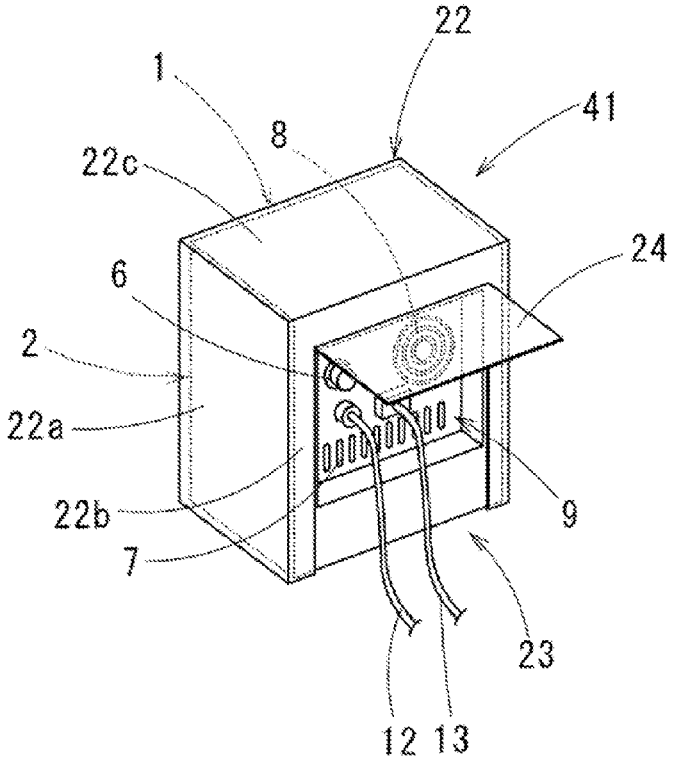
FIG. 10 is a rear perspective view of a speaker cover according to a second embodiment, in a state of covering a speaker.

With a speaker cover 41 shown in FIG. 10, only the overhang portion 24 protruding from the upper end of the open portion 23 of the cover body 22 is provided in a state of protruding horizontally.

Figure 11:
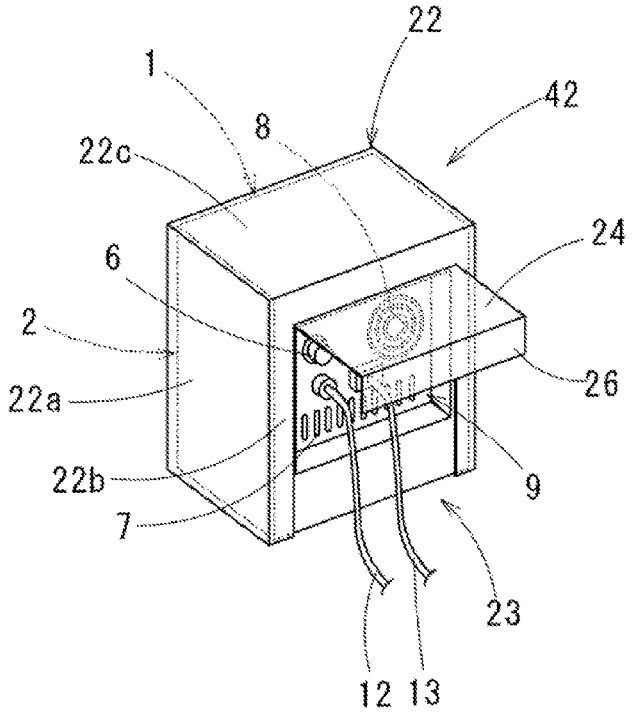
FIG. 11 is a rear perspective view of a variation of the second embodiment.

In a speaker cover 42 shown in FIG. 11, the hanging portion 26 is provided so as to extend vertically downward from the protruding end of the overhang portion 24 that protrudes horizontally.

The speaker covers 41 and 42 shown in FIGS. 10 and 11 do not have the side wall portions below the overhang portion 24, and therefore the material or structure of the cover body 22 and the overhang portion 24 have rigidity capably of allowing the overhang portion 24 to protrude on its own.

Even with this structure in which only the overhang portion 24 protrudes from the upper end of the open portion 23 of the cover body 22, the operation portion 9 can be effectively protected from becoming wet with normal rain or the like falling from directly above when there is little wind.

In an embodiment in which the side wall portions are not provided below the overhang portion 24, and only the overhang portion 24 is provided, by forming the overhang portion 24 so as to extend over the entire width of the side surface portion 22*b* of the cover body 22, in the side surface portion 22*b* provided with the overhang portion 24, it is possible for the portion below the overhang portion 24, excluding the upper end portion of the cover body 22, to serve as the open portion 23.

Also, if the overhang portion is constituted by a flexible fabric, it can be hung down so as to obstruct the open portion 23 when the speaker is not in use. A configuration is possible in which the fabric is rolled up and held at the upper end of the open portion 23, and the rolled fabric functions as the overhang portion.

Figure 12:
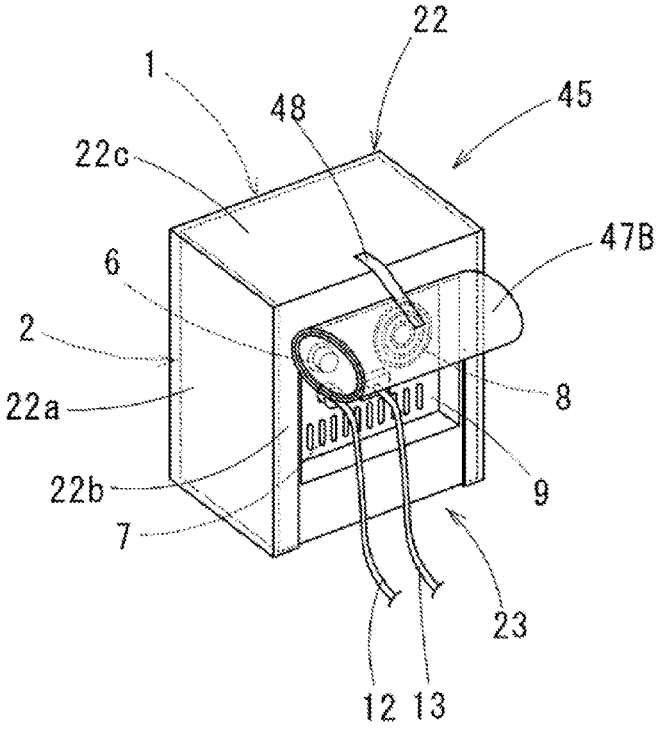
FIG. 12 is a rear perspective view of another variation.
Figure 13:
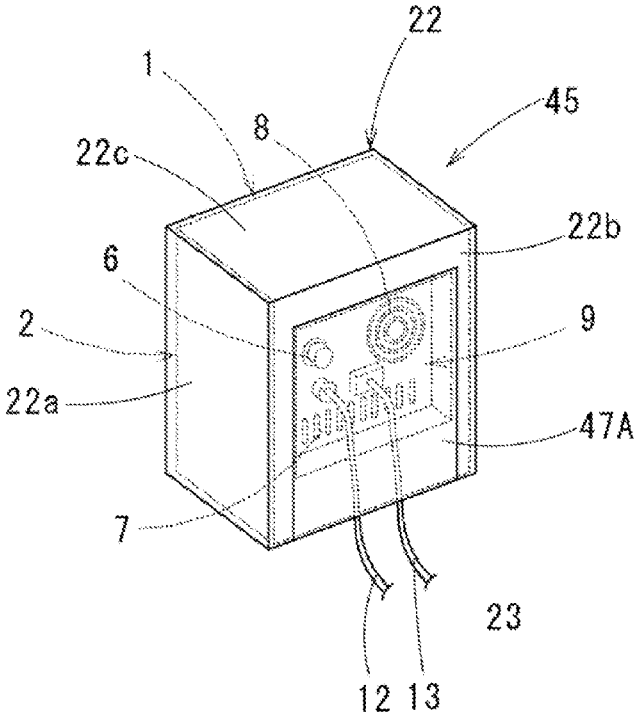
FIG. 13 is a rear perspective view of the speaker cover in FIG. 12, in a state in which an overhang portion is in an obstructing position and obstructing an open portion.

FIGS. 12 and 13 show examples of this type of speaker cover. As shown in FIG. 13, when the speaker is not in use, a portion of a speaker cover 45 functions as a curtain 47A that obstructs the open portion 23 so as to constitute a portion of the side surface portion 22*b* of the cover body 22, and, as shown in FIG. 12, when the speaker is in use, the curtain 47A is rolled up and held to the upper end of the open portion 23 with a fastener 48 such as a hook and loop fastener, thus functioning as an overhang portion 47B.

Also, instead of being rolled up, a configuration is possible in which the curtain 47A is folded in half, thirds, or the like and held to the upper end of the open portion 23 with a fastener such as a hook and loop fastener, such that the folded curtain 47A functions as an overhang portion. It is sufficient that the rolled up overhang portion or folded overhang portion is fixed to the cover body 22 using a detachable fastener 48, cord, or the like so as to prevent the overhang portion from hanging down. Instead of using a hook and loop fastener, a cord, or the like, a configuration is possible in which the overhang portion is held in the protruding position by, for example, one end of rod-shaped members made of a metal, a rigid resin, or the like being fixed to the two side edges of the open portion 23, and the other ends of the rod-shaped members being latched to the protruding end portion of the overhang portion.

Also, a configuration is possible in which, in order to hold the overhang portion in the state of obstructing the open portion 23 as shown in FIG. 13, fasteners such as hook and loop fasteners are provided between the inner edges of the side surface portions 22*b* of the cover body 22 and the two side edges of the hanging overhang portion (curtain 47A).

The present invention also encompasses a configuration in which the overhang portion can be displaced between a protruding position in which it protrudes from the cover body and an obstructing position in which it hangs down along the cover body, and in this case, it is sufficient that the overhang portion is large enough to obstruct the open portion of the cover body when in the obstructing position.

Third Embodiment

In a speaker cover of a third embodiment, side wall portions that do not reach the bottom end of the cover body and are approximately half the length of the open portion are provided on both side ends of the overhang portion.

Figure 14:
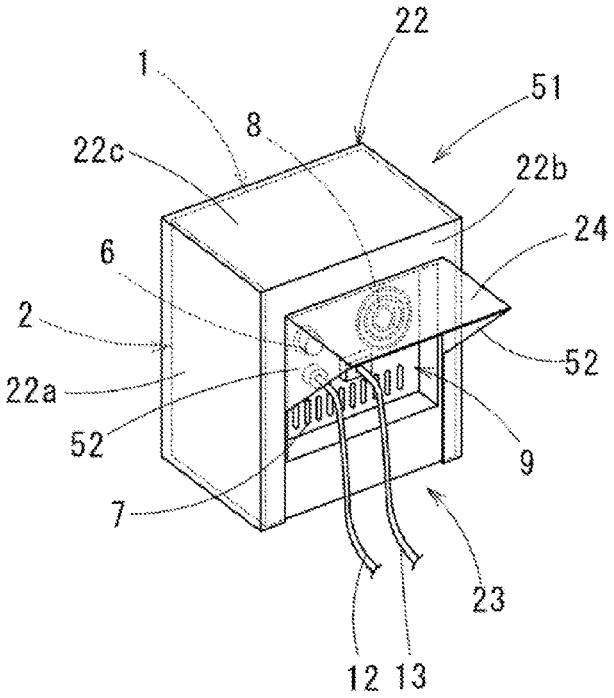
FIG. 14 is a rear perspective view of a speaker cover according to a third embodiment, in a state of covering a speaker.
Figure 15:
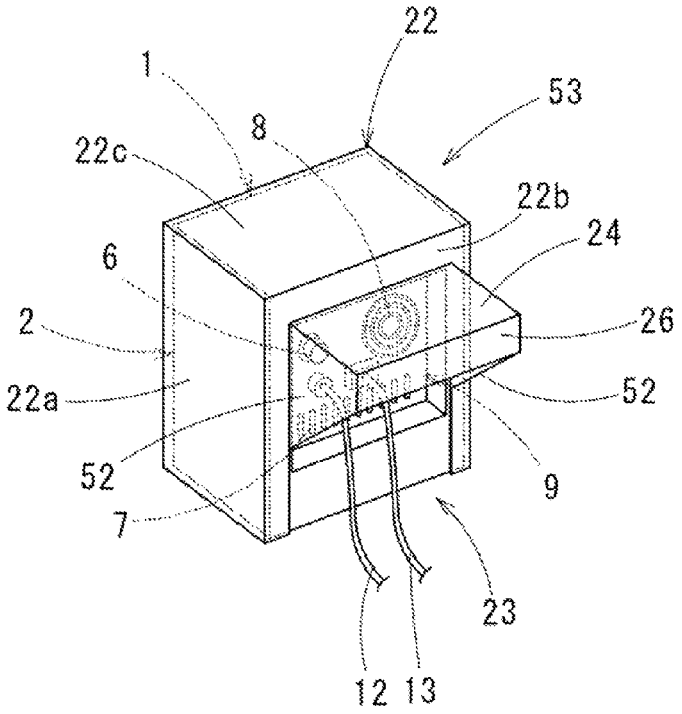
FIG. 15 is a rear perspective view of a variation of the third embodiment.

A speaker cover 51 shown in FIG. 14 is provided with triangular side wall portions 52 that respectively connect the two side ends of the overhang portion 24 to the two side edges of the upper portion of the open portion 23. With a speaker cover 53 shown in FIG. 15, the hanging portion 26 is vertically connected to the protruding end of the overhang portion 24, and the side wall portions 52 respectively connect the two side ends of the overhang portion 24 and the hanging portion 26 to the upper portions of the two side edges of the open portion 23.

With both the speaker covers 51 and 53, side wall portions are not provided in the lower portion of the open portion 23, and it is possible to favorably ensure the flow of air from the surroundings into the intake holes 7.

Note that in the speaker cover of the third embodiment as well, a configuration is possible in which by forming the overhang portion 24 so as to extend over the entire width of the side surface portion 22*b* of the cover body 22, in the side surface portion 22*b* provided with the overhang portion 24, only the upper portion of the cover body 22 is left remaining, and the side wall portions 52 are formed so as to be flush and continuous with the side surface portions 22*a* of the cover body 22.

Fourth Embodiment

In a speaker cover of a fourth embodiment, the speaker cover of the first embodiment is used as a base, and a front wall portion that connects the lower portions of the two side wall portions is provided.

Figure 16:
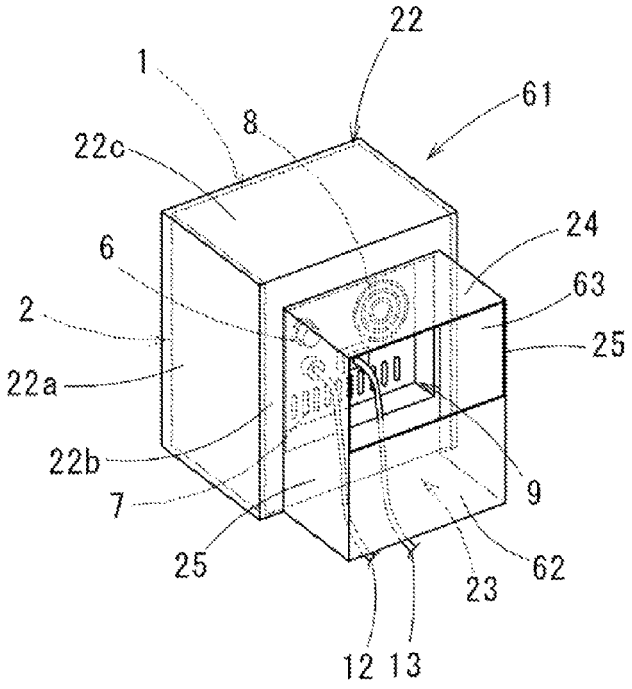
FIG. 16 is a rear perspective view of a speaker cover according to a fourth embodiment, in a state of covering a speaker.

In a speaker cover 61 shown in FIG. 16, an obstructing portion 62 that connects the lower portions of the two side wall portions 25 is provided in the speaker cover 21 shown in FIGS. 3 and 4, and an opening portion 63 is formed between the obstructing portion 62 and the overhang portion 24. Since the bottom surface portion is open, the intake of air into the intake holes 7 in the speaker 1 and the exhaust of air from the exhaust holes 8 through the opening portion 63 are not hindered.

The hanging portion 26 may be vertically connected to the protruding end of the overhang portion 24 in the speaker cover 61 shown in FIG. 16, and in this case, the opening portion 63 is the region between the hanging portion 26 and the obstructing portion 62.

Furthermore, a configuration is possible in which by arranging the two side wall portions 25 so as to be flush with and extend the two side surface portions 22*a* of the cover body 22, and forming the overhang portion 24 so as to extend over the entire width of the side surface portion 22*b* of the cover body 22, the opening portion 63 may be formed over the entire width of the side surface portion 22*b* of the cover body 22.

Fifth Embodiment

Figure 17:
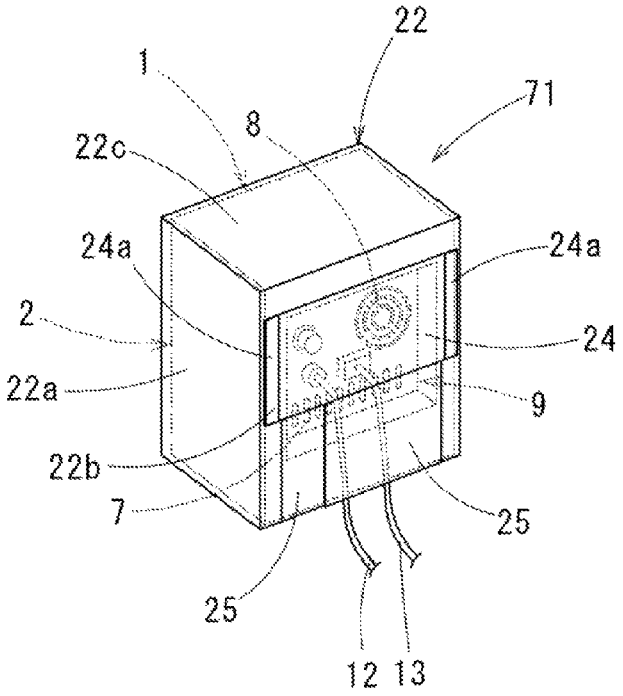
FIG. 17 is a rear perspective view of a speaker cover according to a fifth embodiment, in a state in which an overhang portion and the like are in an obstructing position.
Figure 18:
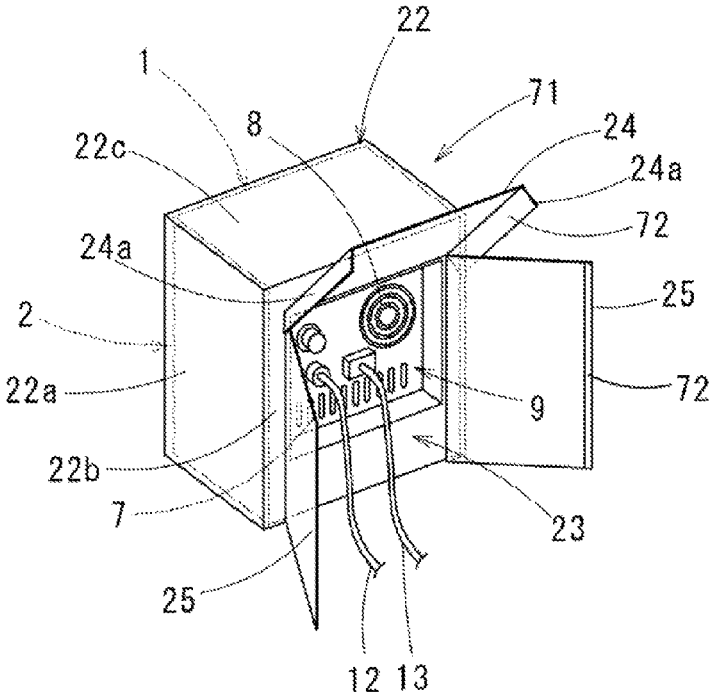
FIG. 18 is a rear perspective view of a state during opening of the overhang portion and the like from the state shown in FIG. 17.
Figure 19:
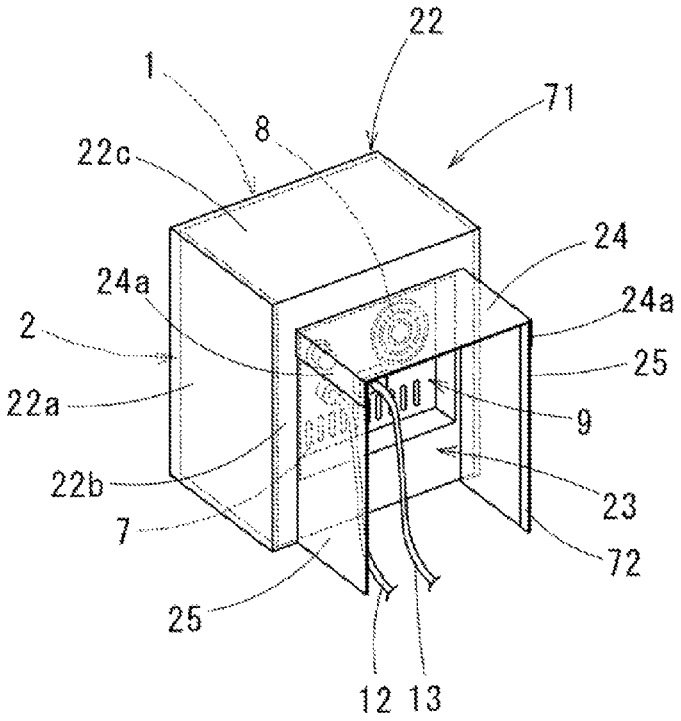
FIG. 19 is a rear perspective view of the speaker cover in FIG. 17, in a state in which the overhang portion and the like are in a protruding position.

FIGS. 17 to 20 show a speaker cover of a fifth embodiment. In a speaker cover 71 of the fifth embodiment, the overhang portion 24 and the side wall portions 25 provided on the cover body 22 can be displaced to various positions. FIG. 17 shows an obstructing position in which the overhang portion 24 and the side wall portions 25 are arranged along the side surface portions 22*b* of the cover body 22 so as to obstruct the open portion 23. FIG. 18 shows an intermediate state in which the overhang portion 24 and the side wall portions 25 protrude from the obstructing position. FIG. 19 shows a protruding position in which the overhang portion 24 and the side wall portions 25 protrude outward from the side surface portions 22*b* of the cover body 22.

As can be understood from this series of figures, the protruding length (length in the width direction) of the two side wall portions 25 is greater than or equal to half the width of the open portion 23 formed in the one side surface portion 22*b* of the cover body 22, and in the obstructing position shown in FIG. 17, the protruding end portions of the two side wall portions 25 overlap each other. It is preferable that the protruding length of the two side wall portions 25 is greater than half the width of the open portion 23. The overhang portion 24 is formed with a width greater than or equal to the width of the open portion 23, and is arranged so as to cover the two side wall portions 25 that close the open portion 23 in the obstructing position shown in FIG. 17. It is preferable that the width of the overhang portion 24 is greater than the width of the open portion 23. In this case, the fabric-like material or the like making up the speaker cover 71 is a material that is rigid enough for the two side wall portions 25 and the like to stand on their own, and fasteners 72 such as hook and loop fasteners that can latch and release the fabric-like material are provided on the inner surfaces of two side portions 24*a* of the overhang portion 24 and the inner surfaces of the tip portions (protruding end portions) of the two side wall portions 25, thus making it possible to hold the obstructing position.

When the overhang portion 24 and the side wall portions 25 are put in the protruding position, as shown in FIG. 19, the two side wall portions 25 are arranged so as to protrude outward at the side edges of the open portions 23, and the overhang portion 24 is arranged so as to cover the two side wall portions 25 at the upper ends thereof. The two side portions 24*a* of the overhang portion 24 are folded onto the outer sides of the side wall portions 25, thus latching the fasteners 72 on the inner surfaces of the two side portions 24*a* to the outer surfaces of the side wall portions 25. This enables preventing the spreading of the two side wall portions 25. Note that the side wall portions 25 may be latched to the outer surfaces of the two side portions 24*a* of the overhang portion 24.

Figure 20:
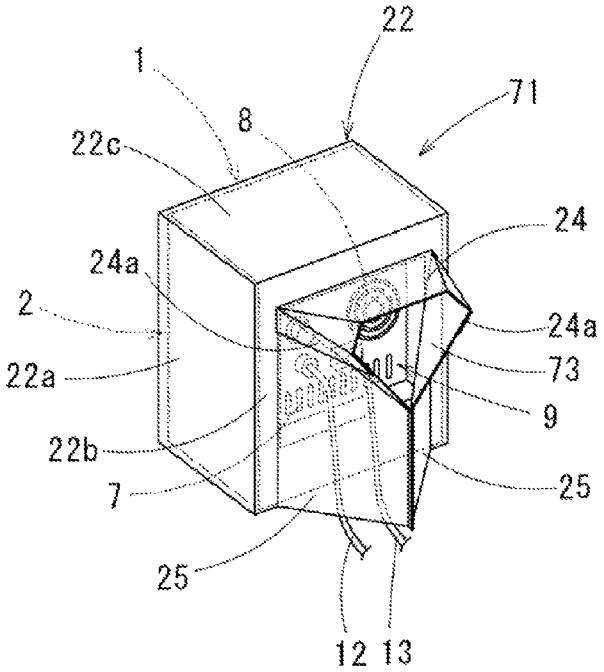
FIG. 20 is a rear perspective view of a state in which the shape of the speaker cover shown in FIG. 19 is changed such that the lower portion is closed and an opening is formed in the upper portion.

FIG. 20 shows a state in which, after the protruding position shown in FIG. 19, the lower portions of the protruding ends of the two side wall portions 25 are held by the fasteners 72 so as to point toward each other, and an opening portion 73 is formed by the overhang portion 24 and the upper portions of the protruding ends of the two side wall portions 25. In the state shown in FIG. 20, a space that is surrounded by the two side wall portions 25 and extends in the up-down direction is formed in front of the open portion 23 of the cover body 22 up to the opening portion 73, thus allowing air from the exhaust holes 8 in the speaker 1 to be smoothly discharged outward via the opening portion 73.

Note that although the two side portions 24*a* are provided on the overhang portion 24, a structure is possible in which side portions are provided on the sides of the side wall portions 25 that oppose the overhang portions 24, and these side portions of the side wall portions 25 are folded inward and support the overhang portion 24 from below, or are latched to the overhang portion 24 from above using fasteners.

Note that the present invention is not limited to the above-described embodiments, and various modifications can be made without departing from the spirit of the present invention.

For example, the side wall portions 25 of the first embodiment shown in FIG. 3 and the like or the fifth embodiment shown in FIG. 17 and the like are not necessarily required to have a length reaching the lower end of the cover body, and they may have a length slightly insufficient for reaching the lower end of the cover body. In particular, in the speaker cover of the fifth embodiment, a chimney-shaped space is formed when the side wall portions are closed as shown in FIG. 20, and the lower portion of the chimney-shaped space is also open to the outside, thus allowing air to flow more smoothly.

Also, although the example of attaching the band 32 is shown in FIG. 5, a configuration is possible in which narrow lower end portions of the side wall portions can be separated, fasteners such as hook and loop fasteners are provided on the tips of the separated lower end portions, and these lower end portions are used as the band.

Also, although these fasteners or the fasteners in fifth embodiment are used, fasteners are not necessarily required, as long as the band portions or the side wall portions and the overhang portion can be latched together.

Furthermore, a pocket capable of housing small items such as cables may be provided on a portion of the cover body.

REFERENCE SIGNS LIST

1 Speaker
2 Housing
3 Diaphragm
6 Operation nob
7 Intake hole
8 Exhaust hole
9 Operation portion
12 Audio cable
13 Power cable
21 Speaker cover
22 Cover body
22*a* Side surface portion
22*b* Side surface portion
22*c* Ceiling surface portion
23 Open portion
24 Overhang portion
24*a* Two side portions
25 Side wall portion
26 Hanging portion
31 Speaker cover
32 Band
33 Adjustment portion
35, 41, 42, 45 Speaker cover
47A Curtain
47B Overhang portion
51 Speaker cover
52 Side wall portion
53, 61 Speaker cover
62 Obstructing portion
63 Opening portion
71 Speaker cover
72 Fastener
73 Opening portion

The invention claimed is:

1. A speaker cover for attachment to a speaker that includes a housing having a plurality of side surfaces and a ceiling surface, and an operation portion provided on a first side surface of the housing, the speaker cover comprising:

a cover body having a plurality of side surface portions configured to respectively cover the plurality of side surfaces of the housing, and a ceiling surface portion connected to the side surface portions and configured to cover the ceiling surface of the housing;

an open portion provided in a first side surface portion of the cover body and configured to expose the operation portion of the speaker;

an overhang portion provided above the open portion and protruding from the cover body; and two side wall portions extending from the overhang portion to a bottom of the housing, wherein the open portion is provided by the overhang portion and the two side wall portions, wherein the first side surface portion of the cover body has a frame portion that covers the first side surface of the housing on an outside of the operation portion, the frame portion having two side frame portions that respectively cover two lateral portions of the first side surface of the housing and an upper frame portion that covers an upper portion of the first side surface of the housing, and wherein the two side wall portions respectively protrude from the two side frame portions, and the overhang portion protrudes from the upper frame portion.

2. The speaker cover according to claim 1, wherein the overhang portion is displaceable between a protruding position of protruding from the cover body and an obstructing position of being arranged along the cover body, and the overhang portion obstructs the open portion when in the obstructing position.

3. The speaker cover according to claim 1, wherein the overhang portion and the side wall portions are displaceable between a protruding position of protruding from the cover body and an obstructing position of being arranged along the cover body, and in the obstructing position, at least one of the overhang portion and the side wall portions, or a combination of at least two out of the overhang portion and the side wall portions obstruct the open portion.

4. The speaker cover according to claim 3, wherein the side wall portions each have a protruding length greater than or equal to half the width of the open portion, an opening portion in communication with an upper portion of the open portion is configured to be formed between the overhang portion and upper portions of the side wall portions by pointing lower portions of protruding ends of the side wall portions toward each other, and the overhang portion and the side wall portions forming the opening portion are configured to be latched to upper end portions of the side wall portions and the two side portions of the overhang portion.

5. A speaker cover for attachment to a speaker that includes a housing having a plurality of side surfaces and a ceiling surface, and an operation portion provided on a first side surface of the housing, the speaker cover comprising:

a cover body having a plurality of side surface portions configured to respectively cover the plurality of side surfaces of the housing, and a ceiling surface portion connected to the side surface portions and configured to cover the ceiling surface of the housing;

an open portion provided in a first side surface portion of the cover body and configured to expose the operation portion of the speaker, the open portion having a first width and a first height and the one of the side surfaces of the speaker having a second width and a second height, the first width being less than the second width, the first height being less than the second height, or the first width and the first height being less than the second width and the second height, respectively;

an overhang portion provided above the open portion and protruding from the cover body; and two side wall portions extending from the overhang portion to a bottom of the housing, wherein the open portion is provided by the overhang portion and the two side wall portions, wherein the first side surface portion of the cover body has a frame portion that covers the first side surface of the housing on an outside of the operation portion, the frame portion having two side frame portions that respectively cover two lateral portions of the first side surface of the housing and an upper frame portion that covers an upper portion of the first side surface of the housing, and wherein the two side wall portions respectively protrude from the two side frame portions, and the overhang portion protrudes from the upper frame portion.

6. The speaker cover according to claim 5, wherein the overhang portion is displaceable between a protruding position of protruding from the cover body and an obstructing position of being arranged along the cover body, and the overhang portion obstruct the open portion when in the obstructing position.

7. The speaker cover according to claim 5, wherein the overhang portion and the side wall portions are displaceable between a protruding position of protruding from the cover body and an obstructing position of being arranged along the cover body, and in the obstructing position, at least one of the overhang portion and the side wall portions, or a combination of at least two out of the overhang portion and the side wall portions obstruct the open portion.

8. The speaker cover according to claim 7, wherein the side wall portions each have a protruding length greater than or equal to half the width of the open portion, an opening portion in communication with an upper portion of the open portion is configured to be formed between the overhang portion and upper portions of the side wall portions by pointing lower portions of protruding ends of the side wall portions toward each other, and the overhang portion and the side wall portions forming the opening portion are configured to be latched to upper end portions of the side wall portions and the two side portions of the overhang portion.

* * * * *